United States Patent [19]

Osawa et al.

[11] Patent Number: 4,914,347

[45] Date of Patent: Apr. 3, 1990

[54] HOT-CATHODE DISCHARGE FLUORESCENT LAMP FILLED WITH LOW PRESSURE RARE GAS

[75] Inventors: Takashi Osawa; Katsuo Murakami; Yoshinori Anzai; Takeo Saikatsu; Seishiro Mitsuhashi; Kazutoshi Ishikawa; Yujiro Kamano; Hiroshi Ito, all of Kanagawa, Japan

[73] Assignee: Mitsubishi Denki Kabushiki Kaisha, Tokyo, Japan

[21] Appl. No.: 263,863

[22] Filed: Oct. 28, 1988

[30] Foreign Application Priority Data

Oct. 28, 1987 [JP] Japan ..... 62-272153

[51] Int. Cl.[4] ..... H01J 61/16

[52] U.S. Cl. ..... 313/485; 313/643

[58] Field of Search ..... 313/484, 643, 576, 637, 313/641, 642, 485

[56] References Cited

U.S. PATENT DOCUMENTS 3,780,330 12/1973 Otsuka et al. ..... 313/484

*Primary Examiner*—Kenneth Wieder

*Attorney, Agent, or Firm*—Burns, Doane, Swecker & Mathis

[57] ABSTRACT

Hot-cathode discharge fluorescent lamps filled with low pressure rare gas being discharge fluorescent lamps filled with low pressure rare gas with a tube diameter of 16 mm or less provided with a pair of electrodes on both ends of a glass tube which operate as a hot-cathode in a stable discharge condition, having a fluorescent material layer on the inside surface of the bulb, filled with a luminous gas therein, and which is illuminated with irradiation from discharge in the luminous gas, in which at least one gas of He, Ne, Ar, and Kr are filled in addition to Xe as the luminous gas in an amount that the percentage of additional gas volume to total gas volume exceeds 50%.

2 Claims, 3 Drawing Sheets

HOT-CATHODE DISCHARGE FLUORESCENT LAMP FILLED WITH LOW PRESSURE RARE GAS

BACKGROUND OF THE INVENTION

1. Field of the Invention

This invention relates to hot-cathode low pressure rare gas filled discharge fluorescent lamps which are used for office-automation apparatus such as copying machines and facsimile equipment.

2. Description of the Prior Art

Recently fluorescent lamps which utilize illumination from rare gas discharge have been used for luminous source of office automation apparatus. An example of such lamps is high luminous glow discharge lamps described in "Toshiba Review" Vol. 40, No. 12, pages 1079 to 1082. The lamp is a cold-cathode rare gas filled fluorescent lamp in which a gas comprising Xe as the main component is filled in this tube, and fluorescent material is excited with ultra-violet rays generated from glow discharge to illuminate. Because the lamp utilizes no mercury, it exhibits stable illumination output over the wide temperature range, and illumination color can be varied by selecting fluorescent material. However the cold-cathode rare gas filled discharge lamp requires a high voltage to start, this is a problem to use this type of lamp. The inventors of the present invention have worked for development of rare gas filled fluorescent lamps suitably used for office automation apparatus having not only a low starting voltage to reduce problems of high voltage by providing hot-cathode electrodes, but also low dependency on temperature and short response time performance, which are advantages of rare gas filled discharge fluorescent lamps, and thus attained to the discharge fluorescent lamps filled with low pressure rare gas having the desired performances.

However a new problem of the hot-cathode discharge fluorescent lamps filled with low pressure rare gas having above mentioned constitution was found, that is, the luminous maintenance deteriorates rapidly as the tube diameter is decreased below 20 mm, wherein such diameter is usually desirable for luminous source of office automation apparatus.

It was found by the inventors that the deterioration of luminous maintenance is caused from ion bombardment of positive column. That is, in a hot-cathode lamp with a thin diameter, the distance between the center axis of positive column and fluorescent material layer is short, particularly in a tube with a diameter of 20 mm or less, hence the fluorescent material deteriorates severely due to the effect of ion bombardment comparing with cold-cathode type lamps, thus this is the cause of rapid deterioration of luminous maintenance.

SUMMARY OF THE INVENTION

This invention is carried out to solve the above mentioned problem, and the purpose of the present invention is to provide hot-cathode discharge fluorescent lamps filled with low pressure rare gas which can be used as usual fluorescent lamps for general illumination and is convenient for use having not only independence on temperature and short response time performance, which are inherent for rare gas filled discharge lamps, but also improved luminous maintenance deterioration due to utilization of thinner tubes.

Hot-cathode discharge fluorescent lamps filled with low pressure rare gas with a tube diameter of 16 mm or less of the present invention contain at least one gas of He, Ne, Ar, and Kr in addition to Xe which is the main component of luminous gas.

In the present invention He, Ne, Ar, and Kr gases added in addition to Xe are chemically stable in lamps and mitigate the effect of ion bombardment on the fluorescent material layer without any adverse effect on other lamp performances. Thus the deterioration of luminance due to ion bombardment is prevented and luminous maintenance is improved even if the tube diameter is thin.

DETAILED DESCRIPTION OF THE PREFERRED EMBODIMENTS

One embodiment of the present invention will be described in detail referring to drawings hereinafter.

Figure 1:
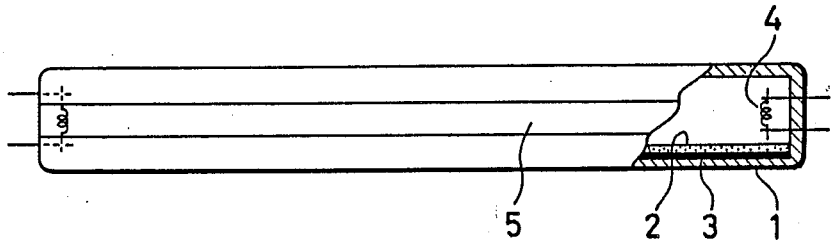
FIG. 1 shows a partial cutaway cross-sectional view to illustrate one embodiment of the invention.

FIG. 1 shows a cross-sectional view of the important portion, and in the drawing, 1 is a bulb, 2 is a fluorescent material layer, 3 is a reflecting layer, 4 is an electrode, and 5 is a slit. A linear glass bulb with a wall thickness of 0.7 mm is used for the bulb 1, and a pair of electrodes 4 is provided on the both ends. The distance between the both electrodes is constantly 260 mm, and the electrodes 4 is a hot-cathode using triple-filament coil coated with emission mix. $Zn_2SiO_4$: Mn green fluorescent material having the brand name P1G1 commercially provided from Kasei Optonics, is used as the fluorescent material layer 2. Between the fluorescent material layer 2 and bulb 1 the reflecting layer 3 is formed. The reflecting layer 3 and also fluorescent material layer 2 form an aperture with the linear slit 5 with a width of 2 mm provided in the longitudinal direction of the tube. A luminous gas is filled in the bulb 1 and evaporated barium getters are provided near the electrode 4, but the both are not illustrated in the drawing.

Then experiment was carried out on the above mentioned fluorescent lamps varying luminous gas. The luminance was measured at the center of the aperture on the middle of the lamp. A 40 KHz sine wave inverter with a L-shaped (choke) ballast was used to start the lamp. The lamp was started as mentioned above to light for 18 min and then switched off for 2 min, and this 20 min cycle was repeated to evaluate the luminous maintenance, wherein it was evaluated as the ratio of luminance at the actual lighting time to the initial luminance.

Figure 2:
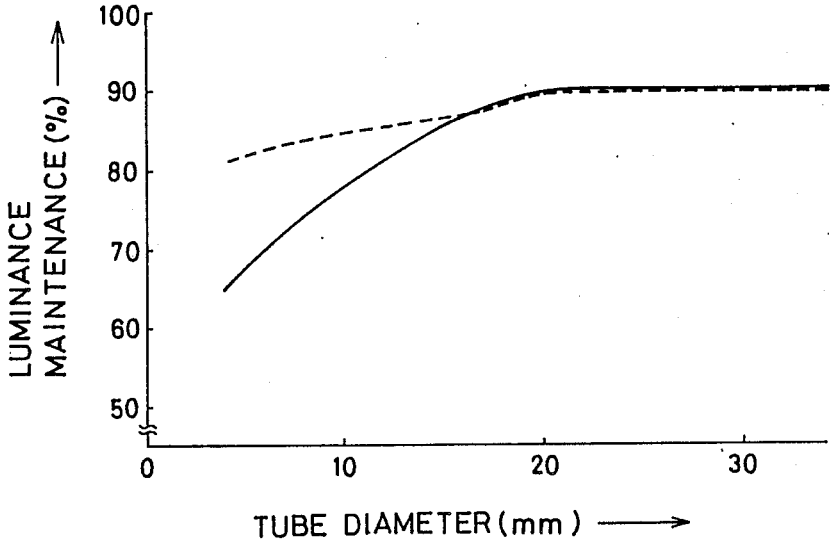
FIG. 2 shows the relation between the tube diameter and luminous maintenance.

FIG. 2 shows the relation between the tube diameter and luminous maintenance, where the solid line represents luminous maintenance values after 1000 hr accumulated switch on time of lamps with various tube diameters in which only Xe of 0.5 Torr was filled. From the experimental result it is obvious that the luminous maintenance decreases as the tube diameter decreases beyond 20 mm, for example, the value is 70% for diameter of 6 mm comparing with 90% for 25 mm, that is, the luminous maintenance decreases by 20%.

Figure 3:
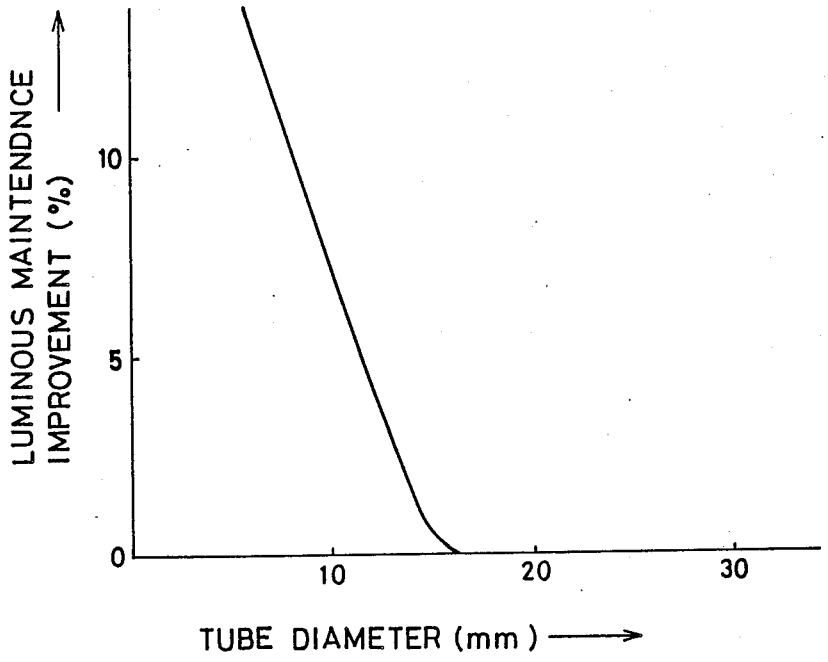
FIG. 3 shows the relation between the tube diameter and deterioration improvement.

The lamp in which Xe was filled with the same pressure of 0.5 Torr and additionally Ne was filled with a pressure of 4.5 Torr, that is total pressure of 5.0 Torr (Xe:20%, and Ne:80%), exhibits the similar behavior as shown by the dotted line, but the luminous maintenance is greatly improved in a range of diameter of 16 mm or less. The difference in luminous maintenance of these two lines is shown in FIG. 3. From the figure it is obvious that the improvement is effective in a range of diameter of 16 mm or less.

Figure 4:
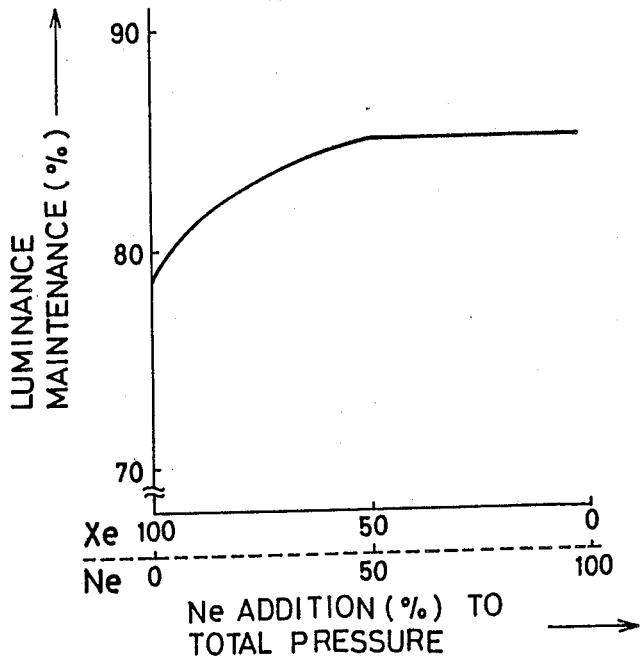
FIG. 4 shows the relation between the Ne addition and luminous maintenance.

Then the quantity of Ne was studied. For example, keeping the tube diameter of 10 mm and total pressure of 0.5 Torr, Ne quantity was varied from zero. The luminous maintenance after 1000 hr behaves as shown in FIG. 4, that is the luminous maintenance saturates at the same quantity as Xe, hence Ne is desirably added in the same quantity as Xe or more, or the mix ratio of 50% or more.

It was found that in the general low pressure range luminance to the initial luminance almost depended on only the partial pressure of Xe, and the initial luminance does not decrease with increasing of the total pressure by adding Ne, differently in behavior from conventional discharge fluorescent lamps filled with low pressure mercury vapor. That is, the luminous maintenance can be improved without deterioration of luminance.

The non-spot life tends to extend by addition of Ne, and the improvement is probably attributed the effect thereof to control evaporation of electron emissive substance coated on the filaments, hence in this point the lamp behaves as a discharge fluorescent lamp filled with low pressure mercury vapor.

In the above mentioned experiments only Ne gas was used as the additional gas, and other rare gases such as He, Ar, and Kr all are effective as Ne, or mixed gases may be used.

The effect is described hereinbefore in the case of using manganese activated zinc silicate green fluorescent material manufactured by Kasei Optonics as the fluorescent material, and the effect was confirmed using other various fluorescent materials such as manganese activated barium aluminate fluorescent material, divalent terbium activated yttrium silicate fluorescent material, trivalent europium activated yttrium gadolinium borate fluorescent material, and divalent europium activated barium magnesium aluminate fluorescent material.

Table 1 shows examples. The above mentioned fluorescent materials were coated on the inside surface of bulbs with an inside diameter of 8 mm to form fluorescent material layers, and using these bulbs lamps which contained 100% Xe as references and desired amount of Ne or Ar in addition to Xe as embodiments of the present invention were fabricated and tested for 1000 hr luminous maintenance.

TABLE 1

| | Xe Pressure (Torr) | Ne Pressure (Torr) | Ar Pressure (Torr) | Fluorescent Material | 1000 Hr Luminous Maintenance (%) |
|---|---|---|---|---|---|
| Comparative Example 1 | 0.5 | — | — | Manganese Activated Zinc Silicate $Zn_2SiO_4$:Mn | 74 |
| Example 1 | " | 0.5 | — | Manganese Activated Zinc Silicate $Zn_2SiO_4$:Mn | 83 |
| Comparative Example 2 | " | — | — | Manganese Activated Barium Aluminate $BaO.6Al_2O_3$:Mn | 70 |
| Example 2 | " | 0.8 | 0.2 | Manganese Activated Barium Aluminate $BaO.6Al_2O_3$:Mn | 85 |
| Comparative Example 3 | " | — | — | Trivalent Terbium Activated Yttrium Silicate $Y_2SiO_5$:Tb | 85 |
| Example 3 | " | — | 1.0 | Trivalent Terbium Activated Yttrium Silicate $Y_2SiO_5$:Tb | 94 |
| Comparative Example 4 | " | — | — | Trivalent Europium Activated Yttrium Gadolinium Borate $(Y,Gd)BO_3$:Eu | 75 |
| Example 4 | " | 0.5 | — | Trivalent Europium Activated Yttrium Gadolinium Borate $(Y,Gd)BO_3$:Eu | 85 |
| Comparative Example 5 | 0.5 | — | — | Divalent Europium Activated Barium Magnesium Aluminate $BaMgAl_{14}O_{27}:Eu^{2+}$ | 72 |
| Example 5 | " | 0.5 | 0.5 | Divalent Europium Activated Barium Magnesium Aluminate $BaMgAl_{14}O_{27}:Eu^{2+}$ | 84 |
| Comparative Example 6 | " | — | — | Trivalent Terbium Activated Yttrium Scandium Silicate $(Y,Sc)_2SiO_5$:Tb | 89 |
| Example 6 | " | 1.0 | — | Trivalent Terbium Activated Yttrium Scandium Silicate $(Y,Sc)_2SiO_5$:Tb | 97 |

Being not shown in Table 1, the effect was observed for lamps using infrared-visible conversion fluorescent material which utilize infrared emission of Xe.

Figure 5:
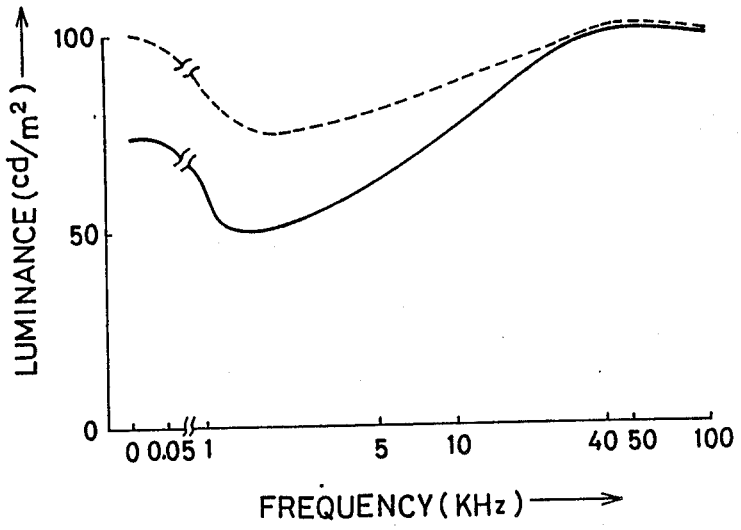
FIG. 5 shows the relation between the starting frequency and luminance.

The tested lamps described in Table 1 were started to light using the same starting condition as used in the above mentioned embodiment, when discharge lamps filled with low pressure rare gas are started using a L-shaped inverter, for example in the case of a lamp with a tube diameter of 10 mm, a partial pressure of Xe of 0.5 Torr, Ne of 0.5 Torr, and total pressure of 1.0 Torr, the relation between frequency and luminance is shown in FIG. 5.

FIG. 5 shows the change in luminance when the frequency was changed from direct current to 100 KHz high frequency sine wave using one lamp, where the luminance is represented by the percentage of luminance to that of 50 KHz. The solid line represents lighting with 100 mA and the dotted line represents lighting with 500 mA. The audio frequency is around 15 KHz, hence the frequency is desirably 15 KHz or more, but the luminance is high in the range of 30 kHz or more and the luminance does not change with fluctuation of tube current, that is, the luminance does not change with fluctuation of source voltage, thus the frequency of around 40 KHz is desirably used for lighting.

In the present invention any electrode which operates as hot-cathode at least in stable discharge condition may be used as the electrode (4), cold-start type electrodes are also included.

The effect of the invention by no means depends on the existence of reflecting layer and aperture type.

This invention provides rare gas filled fluorescent lamps suitable for luminous source of office automation apparatus having a tube diameter of 16 mm or less containing at least one gas of He, Ne, Ar, and Kr in addition to Xe luminous gas, which have low starting voltage for convenience to use, independence of luminance on temperature, and high speed starting performance, but also reduced deterioration of luminous maintenance due to thin tube diameter as described above.

What is claimed is:

1. A hot-cathode discharge fluorescent lamp filled with low pressure rare gas comprising:

a tubular glass bulb made of thin glass having fluorescent material layer on an inside surface thereof, and an inner diameter of 16 mm or less; and a pair of electrodes, one on each end of the tubular glass bulb, at least one of which operates as a hot-cathode at least in a stable discharge condition, the tubular glass bulb containing a mixture of rare gases, the mixture containing Xe and at least one of He, Ne, Ar and Kr at predetermined pressure values, the fluorescent material being illuminated with radiation from a discharge in the mixture of rare gases.

2. Hot-cathode discharge fluorescent lamps filled with low pressure rare gas as claimed in claim 1, wherein the percentage of the above mentioned added gases to the total filled gases in volume exceeds 50%.

* * * * *